US007040024B2

(12) United States Patent
Lukan et al.

(10) Patent No.: US 7,040,024 B2
(45) Date of Patent: May 9, 2006

(54) RAZOR ASSEMBLY STORAGE SYSTEM

(75) Inventors: Sean Lukan, Milford, CT (US); Jay Bunnell, Orange, CT (US); Christine Ciccone, New Haven, CT (US); Paul Dansreau, Shelton, CT (US); David Dombrowski, Madison, CT (US); Mark Peyser, Easton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 56 days.

(21) Appl. No.: 10/794,226

(22) Filed: Mar. 5, 2004

(65) Prior Publication Data

US 2005/0193573 A1 Sep. 8, 2005

(51) Int. Cl.
*B26B 21/40* (2006.01)

(52) U.S. Cl. ..... 30/541; 30/537; 211/88.01; D6/526

(58) Field of Classification Search ..... 30/40, 30/541, 537, 540; 206/470, 471, 228, 223, 206/352, 353, 208; 221/87.01, 100, 123; D6/154, 526; 211/88.01
See application file for complete search history.

(56) References Cited

U.S. PATENT DOCUMENTS

| | | | | |
|---|---|---|---|---|
| 3,186,557 | A | 6/1965 | Wise | |
| 3,277,571 | A * | 10/1966 | Bloomfield | 30/540 |
| 3,869,183 | A * | 3/1975 | Frank, Jr. | 312/248 |
| 3,945,499 | A * | 3/1976 | Brownson | 211/88.01 |
| D254,881 | S * | 5/1980 | Pyskaty | D6/526 |
| D277,434 | S * | 2/1985 | Iten | D6/526 |
| 4,611,716 | A | 9/1986 | Sorlien | |
| 4,742,909 | A | 5/1988 | Apprille, Jr. et al. | |
| 5,228,580 | A | 7/1993 | Grange | |
| 5,240,107 | A | 8/1993 | Casale | |
| 5,242,063 | A | 9/1993 | Ericksen et al. | |
| D370,816 | S * | 6/1996 | Hofman et al. | D6/526 |
| 5,623,955 | A | 4/1997 | Sewell | |
| 5,730,302 | A | 3/1998 | Groene | |
| 5,738,020 | A | 4/1998 | Correia | |
| 5,782,346 | A | 7/1998 | Gray et al. | |
| 5,839,198 | A | 11/1998 | McCoy | |
| 5,862,816 | A | 1/1999 | Lowe | |
| 5,893,213 | A * | 4/1999 | Motta | 30/540 |
| 5,903,978 | A | 5/1999 | Prochaska et al. | |
| 6,179,259 | B1 | 1/2001 | Schioldager | |
| 6,241,388 | B1 | 6/2001 | Terramani | |
| 6,415,517 | B1 | 7/2002 | Worrick, III | |
| D464,222 | S * | 10/2002 | Coffin et al. | D6/526 |
| D495,179 | S * | 8/2004 | Bunnell et al. | D6/526 |
| 2003/0200660 | A1 | 10/2003 | Pennella | |

FOREIGN PATENT DOCUMENTS

GB 2107175 A 4/1983

OTHER PUBLICATIONS

International Search Report, PCT/US2005/007112, dated Aug. 8, 2005.

* cited by examiner

*Primary Examiner*—Hwai-Siu Payer
(74) *Attorney, Agent, or Firm*—Michaud-Duffy Group LLP

(57) ABSTRACT

A shaving equipment system is provided that includes a razor assembly, a replacement cartridge container, and a storage apparatus. The storage apparatus includes a body, a wall attachment mechanism, a razor assembly holder, and a replacement cartridge container holder. The wall attachment mechanism, the razor assembly holder, and the replacement cartridge container holder are attached to the body.

32 Claims, 3 Drawing Sheets

RAZOR ASSEMBLY STORAGE SYSTEM

BACKGROUND OF THE INVENTION

1. Technical Field

This invention relates to shaving devices in general, and to apparatus for storing shaving devices in particular.

2. Background Information

Modern safety razors (also referred to herein as razor assemblies) include a plurality of razor blades disposed within a cartridge that is pivotally or rigidly mounted on a handle. Some safety razors utilize a disposable cartridge for use with a reusable handle, while others have a handle and cartridge that are combined into a unitary disposable.

It is desirable to provide an apparatus for storing a razor assembly that facilitates access to the razor. It is also desirable to provide an apparatus for storing one or more replacement cartridges. An apparatus capable of storing both a razor assembly and one or more replacement cartridges in a shower would be particularly desirable.

DISCLOSURE OF THE INVENTION

According to the present invention, a shaving equipment system is provided that includes a razor assembly, a replacement cartridge container, and a storage apparatus. The storage apparatus includes a body, means for attaching the body to a surface, a post extending out from the body, and an attachment mechanism for attaching the replacement cartridge container to the body. The post is sized to permit hanging of the razor assembly from the post.

The present invention provides the user with a wall mountable unit that includes all of the items generally used during shaving. Several advantages are provided by the present invention. One advantage is that the present storage apparatus positively attaches the razor assembly and the replacement cartridge container to the apparatus to prevent either from being inadvertently dislodged. Another advantage is that the replacement cartridge is provided in a readily accessible manner. When the user determines that the razor cartridge should be replaced, a replacement cartridge is immediately available. Furthermore, because the storage apparatus permits the replacement cartridge to be stored in a container, the replacement cartridge can be protected in a shower environment until it is used. Another advantage is that the storage apparatus positions the razor assembly so that any water that may have collected will be drained.

These and other objects, features, and advantages of the present invention will become apparent in light of the detailed description of the present invention.

DETAILED DESCRIPTION OF THE INVENTION

Figure 1:
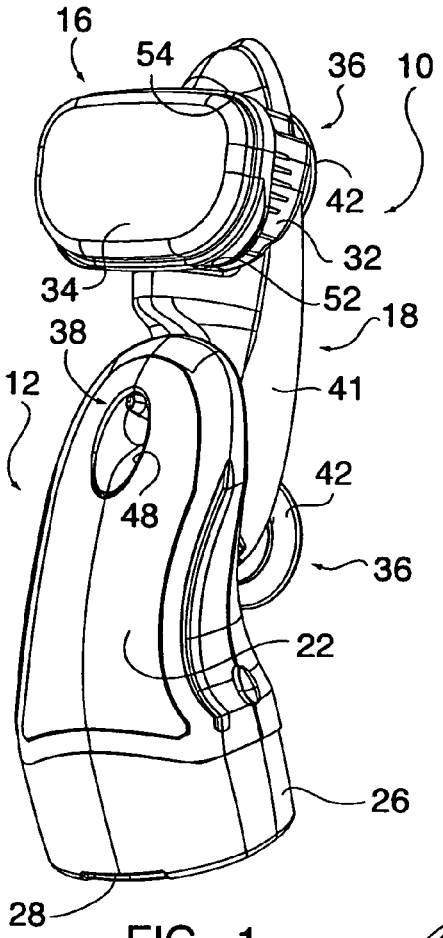
FIG. 1 is a perspective view of the present invention shaving equipment system.

Now referring to FIGS. 1–5, the present invention shaving equipment system 10 includes a razor assembly 12, a replacement cartridge 14, a replacement cartridge container 16, and a shaving equipment storage device 18 referred to herein after as a "caddy".

The razor assembly 12 includes a razor cartridge 20 attached to a handle 22. A specific example of a razor assembly 12 that can be included as a part of the present shaving equipment system 10 is described in U.S. patent application Ser. No. 10/367,255 filed on Feb. 14, 2003, which is hereby incorporated by reference. Briefly stated, the aforesaid razor assembly 12 includes a razor cartridge 20, a shaving aid body 24, a handle 22, a linkage (not shown), and a cover 26. The razor cartridge 20 includes one or more razor blades attached to a frame. Each of the one or more razor blades includes a lengthwise extending cutting edge. The handle 22 includes an aperture 48 that extends widthwise through the handle 22, adjacent an end of the handle 22 opposite the razor cartridge 20 and shaving aid body 24. The aforesaid position of the aperture 48 within the handle 22 enables the razor assembly 12 to hang upside down. As will be described below, a feature 50 is disposed within the aperture 48. The handle further includes a flange disposed adjacent the shaving aid body 24.

The shaving aid body 24 is an erodable solid body that comprises one or more shaving aid materials (e.g., lubricating agents, drag reducing agents, depilatory agents, cleaning agents, medicinal agents, etc.) to enhance the shaving process. The shaving aid body 24 is preferably oval-shaped with a center aperture sized to receive the razor cartridge 20. The shaving aid body 24 may assume other shapes in other embodiments. The handle 22 preferably includes an ergonomically shaped body that includes an internal cavity. The linkage includes at least one member that is connected to both the razor cartridge 20 and the shaving aid body 24. The linkage enables the razor cartridge 20 and the shaving aid body 24 to travel in opposite directions; i.e., when one is pushed downward, the other moves upward. As a result, the surface of the shaving aid body 24 that will contact the surface to be shaved can be maintained approximately co-planar with the cutting edges of the razor cartridge 20.

Figure 4:
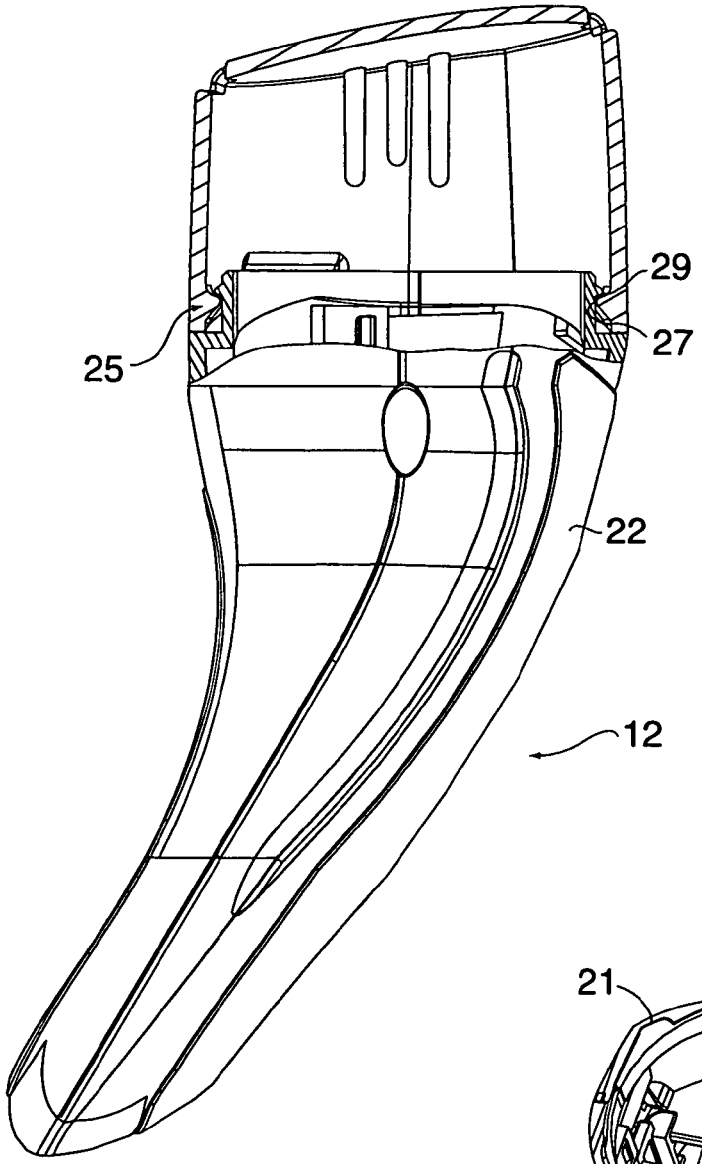
FIG. 4 is a side view of the razor assembly, partially sectioned to show cover attachment means.
Figure 5:
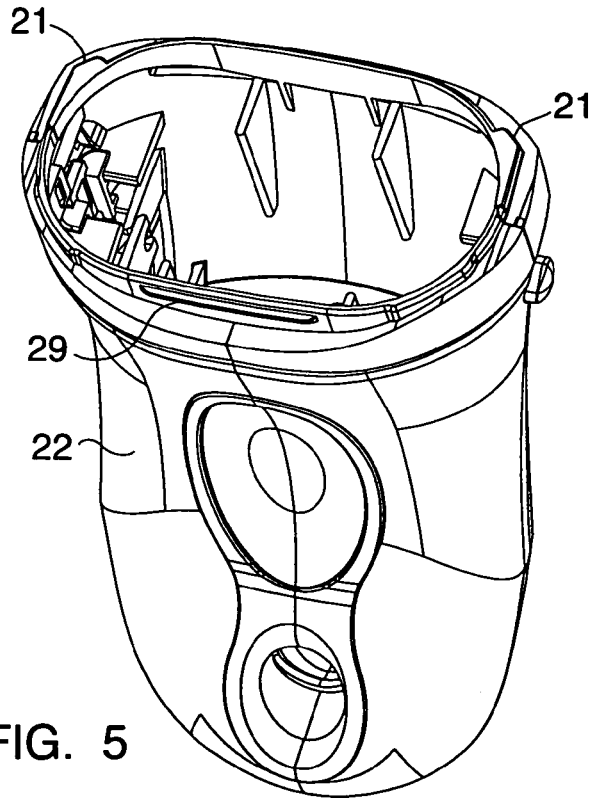
FIG. 5 is a perspective view of the handle.

Referring to FIGS 4. and 5, the razor assembly cover is sized to enclose the shaving aid body and razor cartridge. The cover and handle flange are preferably shaped to mate with one another in a manner that permits attachment of the cover in one orientation only. For example, the flange may be asymmetrically shaped, or may include features that make the flange asymmetrical. In the embodiment shown in FIG. 4, a pair of protrusions 21 extend out from the flange. A means 25 for attaching the cover to the handle 22 is provided that permits the user to selectively attach and remove the cover. The means 25 for attaching the cover to the handle 22 shown in FIG. 4 includes a pair of ribs 27 attached to the cover that cooperate with a pair of ribs 29 attached to the handle 22. The ribs 27,29 cooperate with each other to clip the cover to the handle 22. In the embodiment shown in FIGS. 4 and 5, the ribs 27, 29 are disposed along lengthwise-extending surfaces of the cover and handle 22, respectively. The cover is compliant and shaped such that pressure applied to the widthwise-extending surfaces of the cover (i.e., squeezing the widthwise-extending surfaces toward one another) causes the ribs 27, 29 to disengage with one another and thereby allow the cover to be removed from the handle 22. Other arrangements for securing the cover to the handle may be used alternatively. For example, ribs could be placed on the widthwise-extending surfaces of the cover and handle. In that case, the cover can be shaped so that pressure applied to the lengthwise-extending surfaces would cause the ribs to disengage and allow the cover to be removed from the handle 22.

The cover 26 further includes at least one port 28 that permits liquid to drain out of the cover 26 when the handle 22 is hanging on the caddy 18; i.e., upside down, and permits a controlled amount of ventilation. The cover 26 shown in FIGS. 2 and 4 also includes another port 30 that permits drainage from the cover 26 if, for example, the handle/cover assembly is placed on a side. The ports are sized to permit a predetermined amount of ventilation that ensures that the shaving aid body 24 and other components dry a desirable amount between shaves.

Figure 2:
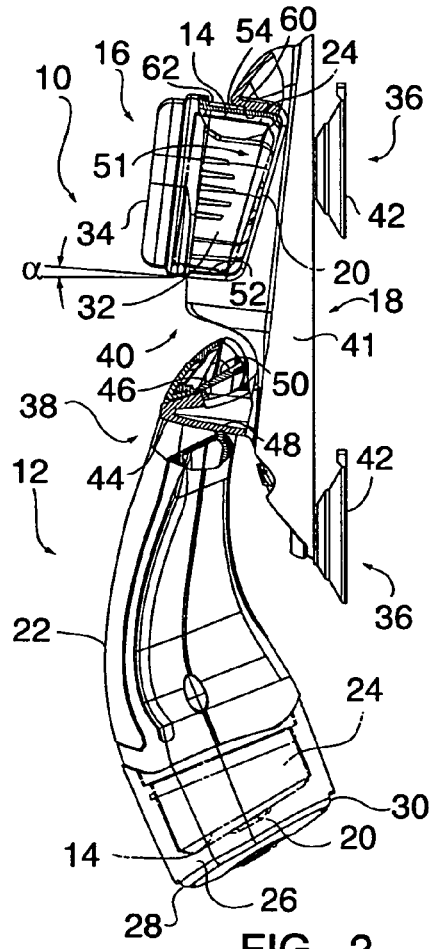
FIG. 2 is a side view of the shaving equipment system shown in FIG. 1, partially sectioned to show particular aspects.
Figure 3:
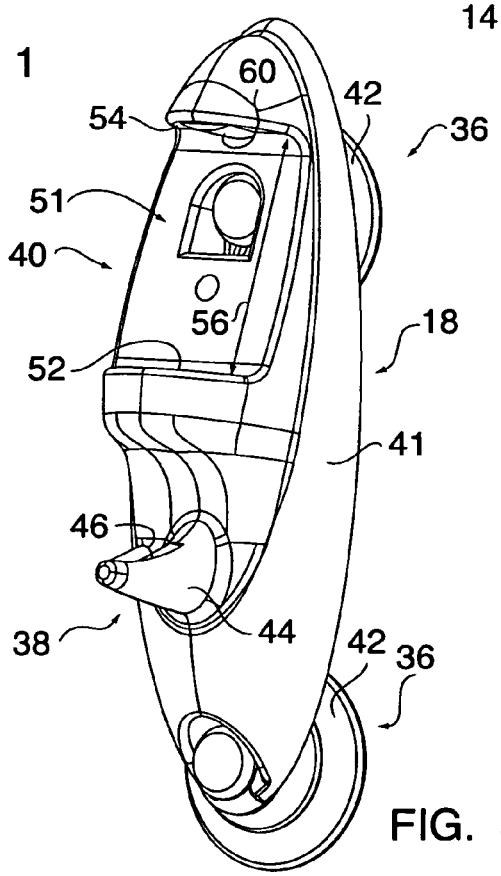
FIG. 3 is a perspective view of the shaving equipment system caddy.

Referring to FIGS. 1–3, the replacement cartridge 14 preferably includes a razor cartridge 20 and a shaving aid body 24 as described above. In some embodiments, the razor cartridge 20 and shaving aid body 24 are independent of one another, and in other embodiments they are coupled together as a unitary assemblage. U.S. patent application Ser. No. 10/367,133 filed on Feb. 14, 2003, which is hereby incorporated by reference, discloses examples of replacement cartridges 14.

The replacement cartridge container 16 includes a tub 32 and a selectively removable lid 34. The tub 32 includes an interior cavity for receiving the replacement cartridge 14, and in some instances a replacement cover 26 as well. The selectively removable lid 34 attaches to the tub 32 to enclose the cavity, and form a seal with the tub 32. The container 16 preferably includes features for locating and securing the replacement cartridge 14 and/or the cover 26 within the container 16. The features facilitate attaching the replacement cartridge 14 to the razor assembly handle 22 by maintaining the replacement cartridge 14 in a desirable position within the tub 32. An example of an acceptable replacement cartridge container 16 is described in U.S. patent application Ser. No. 10/431,250 filed on May 7, 2003, which is hereby incorporated by reference.

The caddy 18 includes a wall attachment mechanism 36, a razor assembly holder 38, and a replacement cartridge container holder 40, all attached to a body 41. The wall attachment mechanism 36 is a device that enables the caddy 18 to be attached to a surface at a given position. In some embodiments, the wall attachment mechanism 36 permits the caddy 18 to be selectively attached and reattached to the surface. In FIGS. 1–3, the wall attachment mechanism 36 is shown as a pair of suction cups 42. The wall attachment mechanism 36 is not limited to suction cups 42, however. Alternative wall attachment mechanisms 36 include adhesive, magnets, hook and loop fasteners, etc.

The razor assembly holder 38 includes a post 44 with a barb 46. The post 44 is sized to be received within an aperture 48 within the handle 22 of the razor assembly 12. The post 44 supports the razor assembly 12 and enables it to hang in a position wherein any liquid that may have collected within the razor assembly 12 can drain. The barb 46 mates with a feature 50 within the aperture 48 of the handle 22 to prevent the razor assembly 12 from unintentionally disengaging from caddy 18. The razor assembly holder 38 is not limited to the post 44 and barb 46 embodiment described. The razor assembly holder 38 can assume alternative forms wherein the razor assembly 12 is clipped or otherwise supported and selectively attached to the caddy 18.

Figure 7:
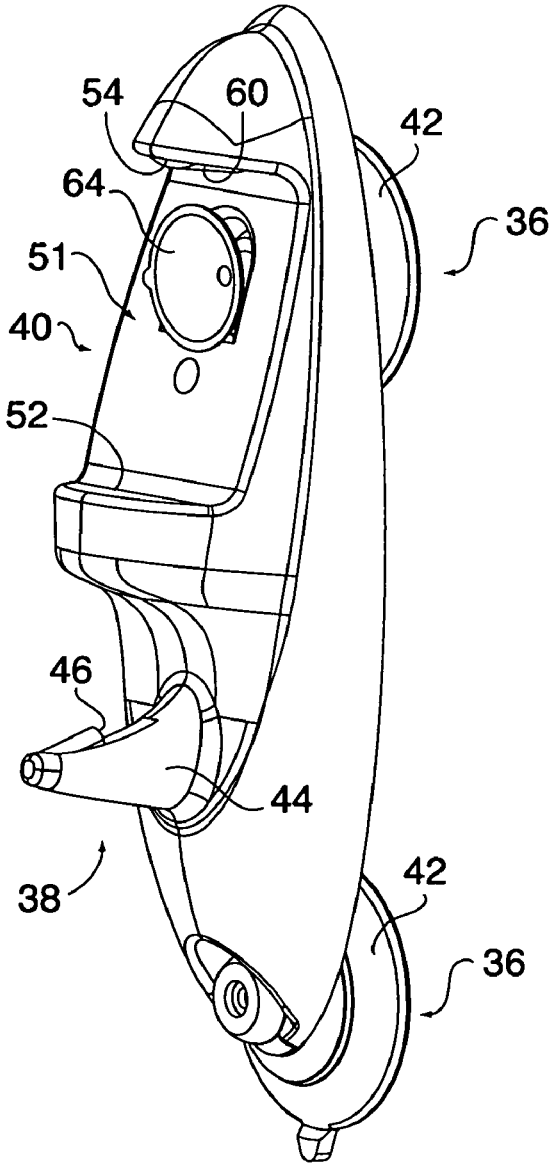
FIG. 7 is a perspective view of an embodiment of the shaving equipment system caddy.
Figure 6:
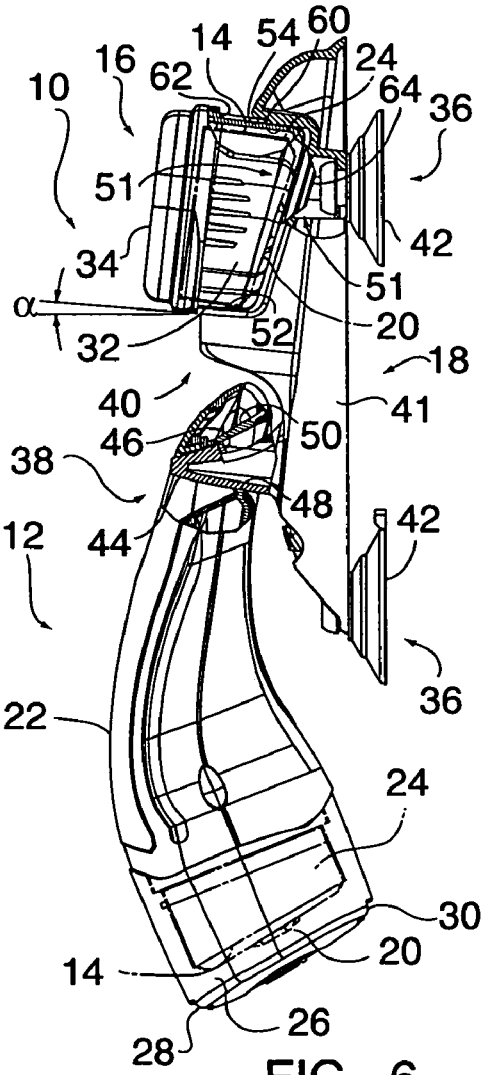
FIG. 6 is a side view of an embodiment of the shaving equipment system, partially sectioned to show particular aspects.
Figure 8:
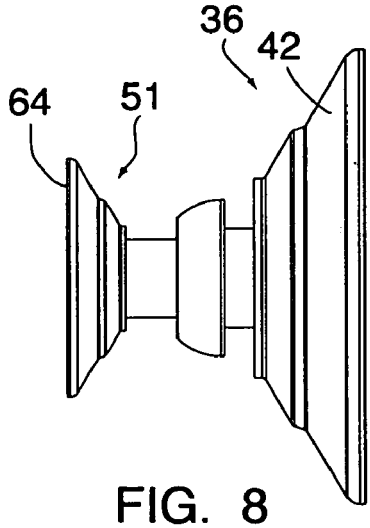
FIG. 8 is a side view of elements of a wall attachment mechanism and a container attachment mechanism.

The replacement cartridge container holder 40 includes a container attachment mechanism 51 that permits the replacement cartridge container 16 to be selectively attached and reattached to the caddy 18. In the embodiment shown in FIGS. 1–3, the attachment mechanism 51 includes a first panel 52 and a second panel 54 spaced apart from one another by a distance 56, and a tab 60 that extends outwardly from the second panel 54, generally toward the first panel 52. The replacement cartridge container 16 includes a slot 62 for receiving the tab 60. The replacement cartridge container 16 fits between the first panel 52 and the second panel 54. When received within the slot 62, the tab 60 operates to prevent unintentional disengagement of the container 16 from the caddy 18. In a preferred embodiment, the first panel 52 and second panel 54 are substantially parallel and each are skewed at an angle "$\alpha$" from a horizontal plane. The skew of the panels 52,54 helps to prevent unintentional disengagement of the container 16 from the caddy 18. In the embodiment shown in FIGS. 6–8, the attachment mechanism 51 further includes a suction cup 64 disposed between the first panel 52 and the second panel 54. The suction cup 64 is positioned to engage the container 16 when the container 16 is disposed between the panels 52,54. FIGS. 6–8 show an embodiment wherein the suction cup 64 is attached to a suction cup 42 that is part of the wall attachment mechanism 36. The container attachment mechanism 51 is not limited to the embodiment described above, however. Alternative container attachment mechanisms (e.g., independent suction cups, hook and loop fasteners, buttons, combinations thereof, etc.) can be used in place thereof.

Although this invention has been shown and described with respect to the detailed embodiments thereof, it will be understood by those skilled in the art that various changes in form and detail thereof may be made without departing from the spirit and scope of the invention.

What is claimed is:

1. A shaving equipment system, comprising a razor assembly;

a replacement cartridge container; and a storage apparatus that includes:

a body;

means for attaching the body to a surface;

means for holding the razor assembly; and means for attaching the replacement cartridge container to the body;

wherein the means for holding the razor assembly is attached to the body; and wherein the means for attaching the replacement cartridge container is attached to the body and comprises opposingly-positioned panels substantially parallel to each other and are skewed upward at an angle from a horizontal reference plane to hold the replacement cartridge container at an upwardly skewed angle.

2. The system of claim 1, wherein the means for holding the razor assembly is operable to hold the razor assembly in a position that enables the razor assembly to drain of fluids.

3. The system of claim 2, wherein the razor assembly includes a cover that covers a shaving aid body and the cover has one or more ports that permit fluid drainage.

4. The system of claim 2, wherein the means for holding the razor assembly is operable to hold the razor assembly in a position wherein a razor cartridge element of the razor assembly is disposed vertically below a handle element of the razor assembly.

5. The system of claim 2, wherein the razor assembly includes a cover and a means for attaching the cover to a handle of the razor assembly.

6. The system of claim 5, wherein the means for attaching the cover to the handle includes at least one rib attached to each of the cover and the handle that engage each other to attach the cover to the handle.

7. The system of claim 6, wherein the cover is compliant and the means for attaching the cover is disengageable by squeezing opposing surfaces of the cover substantially toward one another.

8. The system of claim 1, wherein the razor assembly includes a cover and a handle, and the cover and the handle are shaped to mate with one another in manner that permits attachment of the cover and the handle together in only a single orientation.

9. The system of claim 8, wherein the handle includes an asymmetrical shaped flange that cooperates with the cover.

10. The system of claim 8, wherein the handle includes one or more protrusions asymmetrically positioned that cooperate with the cover to enable attachment of the cover to the handle in a single direction.

11. The system of claim 1, wherein the means for attaching the body to the surface is operable to permit the storage apparatus to be selectively attached and reattached to a wall.

12. The system of claim 11, wherein the means for holding the razor assembly includes a post that extends outwardly from the body, and a barb attached to the post; wherein the post is sized to be received within an aperture disposed in the razor assembly.

13. The system of claim 1, wherein the means for attaching the replacement cartridge container is operable to permit the replacement cartridge container to be selectively attached and reattached to the storage apparatus.

14. The system of claim 13, wherein the replacement cartridge container comprises a means for attaching the replacement cartridge container.

15. The system of claim 14, wherein the means for attaching the replacement cartridge container further comprises one or more tabs that extend out from one or both of the opposingly-positioned panel.

16. The system of claim 1, wherein the razor assembly includes a cover and a handle, wherein the cover includes at least one port that permits a predetermined amount of ventilation through the port.

17. A shaving equipment storage apparatus, comprising:

a body;

means for attaching the body to a surface;

means for holding a razor assembly; and means for attaching a replacement cartridge container;

wherein the means for holding the razor assembly is attached to the body; and wherein the means for attaching the replacement cartridge container is attached to the body and comprises opposingly-positioned panels substantially parallel to each other and are skewed upward at an angle from a horizontal reference plane to hold the replacement cartridge container at an upwardly skewed angle.

18. The apparatus of claim 17, wherein the means for attaching the body to the surface is operable to permit the shaving equipment storage apparatus to be selectively attached and reattached to a wall.

19. The apparatus of claim 18, wherein the means for attaching the body to the surface comprises one or more first suction cups.

20. The apparatus of claim 19, wherein the means for attaching the replacement cartridge container includes a second suction cup for engaging the replacement cartridge container.

21. The apparatus of claim 20, wherein one of the one or more first suction cups is connected to the second suction cup.

22. The apparatus of claim 17, wherein the means for holding the razor assembly is operable to hold a razor assembly in a position that enables the razor assembly to drain of fluids.

23. The apparatus of claim 22, wherein the means for holding the razor assembly is operable to hold the razor assembly in a position wherein a razor cartridge element of the razor assembly is disposed vertically below a handle element of the razor assembly.

24. The apparatus of claim 22, wherein the means for holding the razor assembly includes a post that extends outwardly from the body.

25. The apparatus of claim 24, wherein the means for holding the razor assembly further comprises a barb extending out from the post.

26. The apparatus of claim 17, wherein the means for attaching the replacement cartridge container is operable to permit the replacement cartridge container to be selectively attached and reattached to the shaving equipment storage apparatus.

27. The apparatus of claim 26, further comprising a replacement cartridge container holder that comprises the means for attaching the replacement cartridge container.

28. The apparatus of claim 27, wherein the means for attaching the replacement cartridge container further comprises one or more tabs that extend out from one or both of the opposingly-positioned panels.

29. The apparatus of claim 28, wherein the means for attaching the replacement cartridge container further includes a first suction cup that engages the replacement cartridge container.

30. The apparatus of claim 14, wherein the first suction cup is connected to a suction cup portion of the means for attaching the body to the surface.

31. The apparatus of claim 11, wherein the means for attaching the replacement cartridge container further includes a first suction cup that engages the replacement cartridge container.

32. The apparatus of claim 31, wherein the first suction cup is connected to a suction cup portion of the means for attaching the body to the surface.

* * * * *